United States Patent [19]

Scherer et al.

[11] Patent Number: 4,805,894

[45] Date of Patent: Feb. 21, 1989

[54] STACKING METHODS AND APPARATUS

[75] Inventors: Andrew J. Scherer, San Dimas; Dwight G. Westover, Sierra Madre; William H. Spencer, Monrovia; Bayani E. Roldan, Glendale, all of Calif.

[73] Assignee: TransTechnology Corporation, Sherman Oaks, Calif.

[21] Appl. No.: 873,517

[22] Filed: Jun. 12, 1986

[51] Int. Cl.[4] ..... B65H 39/10

[52] U.S. Cl. ..... 271/297; 271/305; 271/181; 414/790.9; 414/798.7

[58] Field of Search ..... 271/177–181, 271/297, 303, 305; 414/51, 108, 907; 209/941; 318/436

[56] References Cited

U.S. PATENT DOCUMENTS

| | | | |
|---|---|---|---|
| 2,076,700 | 4/1937 | Bryce | 271/305 X |
| 2,742,286 | 4/1956 | Williams et al. | 271/305 |
| 2,822,171 | 2/1958 | Luning | 271/185 |
| 2,844,373 | 7/1958 | Marle | 271/178 |
| 3,052,467 | 9/1962 | Fertig | 271/217 X |
| 3,148,879 | 9/1964 | Kistner | 271/176 |
| 3,266,798 | 8/1966 | Bleiman | 271/181 X |
| 3,385,598 | 5/1968 | Kim | 271/177 X |
| 3,580,563 | 5/1971 | Bassett | 271/297 X |
| 3,601,265 | 8/1971 | Shields | 271/212 X |
| 3,761,079 | 9/1973 | Azure, Jr. | 271/116 |
| 3,805,971 | 4/1974 | Behrens et al. | 271/212 X |
| 3,808,483 | 4/1974 | Kembuegler | 318/436 |
| 4,012,034 | 3/1977 | Nelson | 271/290 |
| 4,019,730 | 4/1977 | Staudinger | 271/181 |
| 4,067,568 | 1/1978 | Irvine | 271/212 X |
| 4,068,837 | 1/1978 | Lamos | 271/180 |
| 4,106,766 | 8/1978 | Stefansson | 271/181 |
| 4,241,909 | 12/1980 | Murphy et al. | 271/182 |
| 4,444,388 | 4/1984 | Stefansson et al. | 271/293 |
| 4,650,178 | 3/1987 | Steele et al. | 271/297 |

FOREIGN PATENT DOCUMENTS

| | | | |
|---|---|---|---|
| 1269056 | 5/1968 | Fed. Rep. of Germany | 271/87 |
| 2240882 | 2/1974 | Fed. Rep. of Germany | 271/303 |

*Primary Examiner*—Joseph J. Rolla
*Assistant Examiner*—David H. Bollinger
*Attorney, Agent, or Firm*—Benoit Law Corporation

[57] ABSTRACT

Methods and apparatus for stacking predetermined sheets of various intermixed sizes in a stacking location by advancement of stacking devices into that location, selectively guide further sheets past the stacking location. That guiding of further sheets past the stacking location is mechanically slaved to the advancement of the stacking devices into the stacking location. Where the stacking devices are withdrawn from the stacking location preparatory to each stacking of a predetermined sheet, the guiding of that predetermined sheet into the stacking location is mechanically slaved to such withdrawal of the stacking devices. Where the sheets are stacked against a movable wall, an unobstructed space for receiving each sheet guided to the stacking location is permanently preserved between the movable wall and the withdrawn stacking devices.

36 Claims, 9 Drawing Sheets

STACKING METHODS AND APPARATUS

BACKGROUND OF THE INVENTION

1. Field of the Invention

The subject invention relates to stacking methods and apparatus and, more specifically, to methods and apparatus for stacking papers, documents, cards, payment checks, billing stubs, and other sheets of various intermixed lengths, thicknesses and other characteristics.

2. Information Disclosure Statement

The following disclosure statement is made pursuant to the duty of disclosure imposed by law and formulated in 37 CFR 1.56(a). No representation is hereby made that information thus disclosed in fact constitutes prior art, inasmuch as 37 CFR 1.56(a) relies on a materiality concept which depends on uncertain and inevitably subjective elements of substantial likelihood and reasonableness and inasmuch as a growing attitude appears to require citation of material which might lead to a discovery of pertinent material though not necessarily being of itself pertinent. Also, the following comments contain conclusions and observations which have only been drawn or become apparent after conception of the subject invention or which contrast the subject invention or its merits against the background of developments which may be subsequent in time or priority.

U.S. Pat. No. 2,822,171, issued Feb. 4, 1958, for a stacker arrangement, by G. A. Luning, proposes oscillation of card engaging devices between advanced and retracted positions to guide the forward portion of each card into the stacking station in the advanced position and to release the rear portion of each card in succession in the retracted position.

U.S. Pat. No. 2,844,373, issued July 22, 1958, for mail stacking equipment, by F. Van Marle, discloses use of a rotating disc with curved fingers for receiving and depositing sheets in a stack.

U.S. Pat. No. 3,052,467, issued Sept. 4, 1962, for a stacker for intermixed documents of varying size, by F. L. Fertig, discloses combination of a roll and a guide member for providing a constriction through which documents are fed serially and a deflector spring for deflecting the trailing portion of each document.

U.S. Pat. No. 3,148,879, issued Sept. 15, 1964, for stacking apparatus, by H. J. Kistner, discloses a stacking of sheets against a movable wall with the aid of rocking pushers.

U.S. Pat. No. 3,385,598, issued May 28, 1968, for pneumatic filing device, by Jong-Dok Kim, discloses a brake plate having a suction surface for stopping movement of entering sheets, and a mechanical or pneumatic mechanism facilitating the release of each sheet from the brake plate.

U.S. Pat. No. 3,601,265, issued Aug. 24, 1971, for blank stacking, straightening, and delivery apparatus,by A. F. Shields, discloses roller-equipped arms for assisting bottom-fed sheets in their upward travel.

U.S. Pat. No. 3,761,079, issued Sept. 25, 1973, for document feeding mechanism, by L. L. Azure, discloses driving a sheet feed roller through a lost motion clutch.

U.S. Pat. No. 3,805,971, issued Apr. 23, 1974, for stack stabilizer for paper stacking machine, by R. E. Behrens et al, discloses provision of wheels rotatably supported by swingable arms at a stacking station.

U.S. Pat. No. 4,012,034, issued Mar. 15, 1977, for multiple modular sorter system, by J. A. Nelson, discloses actuation of sheet entry gates by rotating cams via cam followers.

U.S. Pat. No. 4,019,730, issued Apr. 26, 1977, for envelope stacking system, by F. J. Staudinger et al, discloses stacking of envelopes against a movable wall by cams projecting through windows at a feed stacker for pushing envelopes out of contact with rollers driving these envelopes into the stacker.

U.S. Pat. No. 4,067,568, issued Jan. 10, 1978, for document feeding and stacking apparatus, by R. Irvine, discloses a rotating structure having rollers attached thereto for transporting documents into a stack.

U.S. Pat. No. 4,068,837, issued Jan. 17, 1978, for paper hold-down device for a collector, by R. A. Lamos, discloses cam-operated hold-down arms for holding down the trailing edge of the stack at an entrance, while the next sheet is fed onto the stack.

U.S. Pat. No. 4,106,766, issued Aug. 15, 1978, for sheet handling and stacking methods and apparatus, by R. Stefansson, discloses stacking of documents against a movable wall with the aid of a thumper which is oscillated in response to power transmission by entering sheets.

U.S. Pat. No. 4,241,909, issued Dec. 30, 1980, for document stacking apparatus, by G. J. Murphy et al, discloses a gravity-bias principle in conjunction with a power drive roller having an elastomeric serrated extended diameter cap, and a roller mechanism, rotatable in a direction counter to that which would normally feed documents through a predetermined path, for retarding the movement of documents and facilitating their stacked arrangement within the stacking cavity. In a commercial version of that type of stacker, a reversely rotating square-shaped elastomeric member is employed in lieu of the document retarding roller mechanism.

In practice, gravity-bias systems are not universally applicable, also, the use of elastomeric serrated roller caps or square-shaped roller members may impose noticeable vibration on the stacking apparatus and entail accelerated wear.

U.S. Pat. No. 4,444,388, issued Apr. 24, 1984, for stacking methods and apparatus, by R. Stefansson, discloses distinct first and second sheet drive rollers which are rocked for a stacking of sheets of various intermixed lengths in a stacking location. While that system has performed excellently, it appears to have an inherent speed limitation beyond which the velocity of the stacking process cannot practically proceed.

Also, many if not practically all of the known stacker systems in practice require extensive controls or mechanisms for controlling the sheet entry gate in addition to any stacking devices. Another factor which has impeded achievement of higher stacking speeds and quality has been an impediment of the sheet entry area at the stacker by the stacking means themselves.

SUMMARY OF THE INVENTION

It is a general object of this invention to overcome the disadvantages or meet the needs expressed or implicit in the above Information Disclosure Statement or in other parts hereof.

It is a germane object of this invention to provide improved stacking methods and apparatus.

It is a related object of this invention to provide improved methods and apparatus for stacking sheets of various intermixed lengths.

It is also an object of this invention to increase the speed of sheet stacking operations.

Other objects of the invention will become apparent in the further course of this disclosure.

From a first aspect thereof, the subject invention resides in methods and apparatus for stacking predetermined sheets of various intermixed sizes in a stacking location by advancement of stacking means into that stacking location, and of selectively guiding further sheets past the stacking location. The invention according to this aspect resides in the improvement comprising the step of, or means for, mechanically slaving the guiding of further sheets past the stacking location to the advancement of stacking means into the stacking location.

Alternatively or additionally, the subject invention resides in a combination of steps of, or means for, effecting a withdrawal of the stacking means from the stacking location preparatory to each stacking of a predetermined sheet, mechanically slaving a guiding of the predetermined sheet into the stacking location to the withdrawal of the stacking means, and depositing the guided predetermined sheet in the stacking location by advancement of the withdrawn stacking means into the stacking location.

Also alternatively or additionally, the subject invention, from a further aspect thereof, resides in methods and apparatus for driving a load in opposite first and second directions, respectively, and, more specifically, resides in the improvement comprising in combination the steps of, or means for, providing an electric motor with a first mechanical stop and with an opposite second mechanical stop, coupling said motor to that load, energizing that motor for rotation in a first sense so as to drive that load in one of that first and second directions until that motor has reached the first stop, energizing that motor for rotation in an opposite second sense so as to drive that load in the other of that first and second direction until that motor has reached the second stop, and continuing energization of that motor after either of that first and second stops have been reached.

Other aspects of the invention will become apparent in the further course of this disclosure, and no restriction to any specific method, step, apparatus, component or feature is intended by this brief summary of the invention.

BRIEF DESCRIPTION OF THE DRAWINGS

The subject invention and its various objects and aspects will become more readily apparent from the following detailed description of preferred embodiments thereof, illustrated by way of example in the accompanying drawings, in which like reference numerals designate like or functionally equivalent parts, and in which.

DESCRIPTION OF PREFERRED EMBODIMENTS

Figure 1:
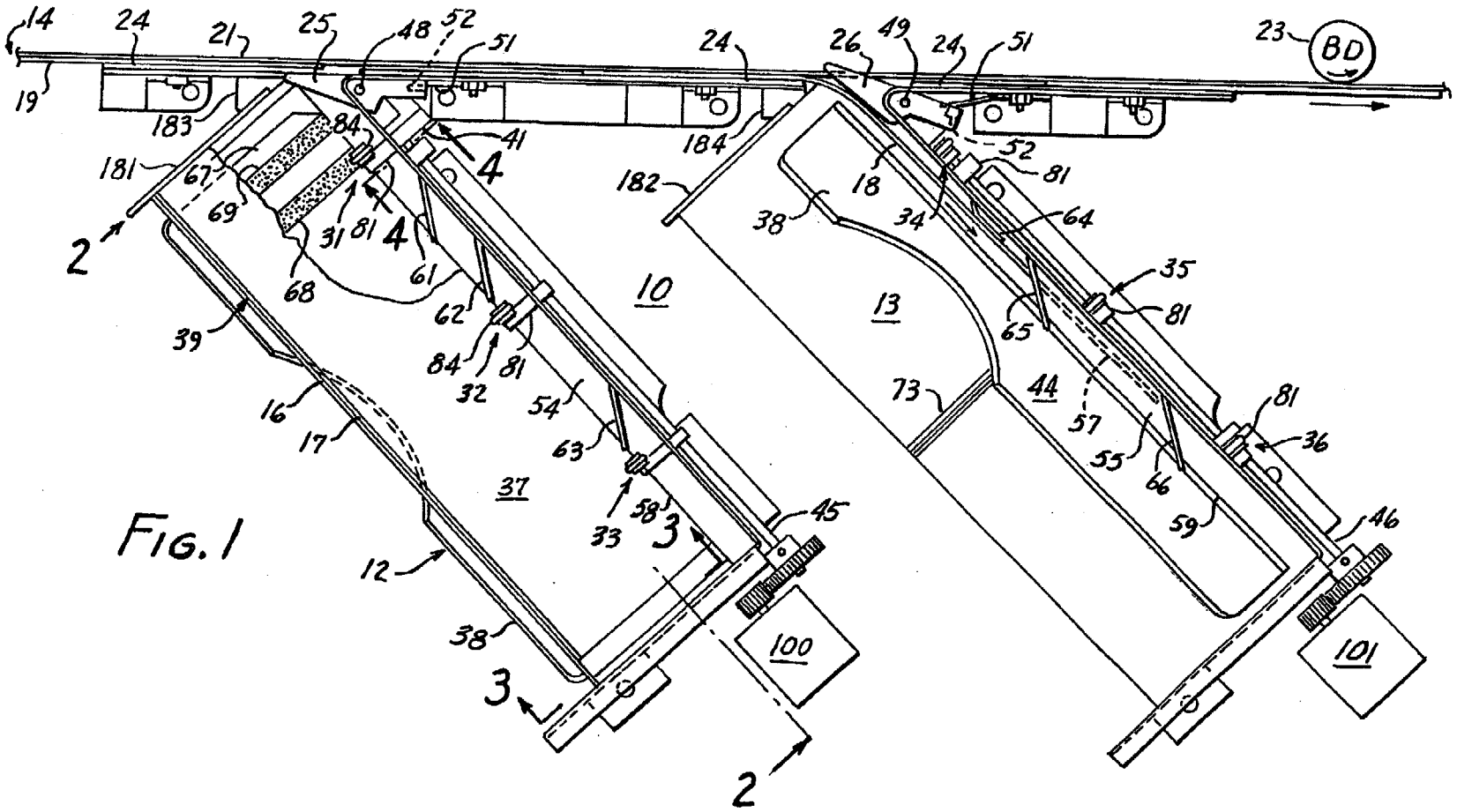
FIG. 1 is a top view of a stacking system according to a preferred embodiment of the subject invention.

The stacking system 10 shown in the drawings has several mutually spaced stackers, two of which are shown at 12 and 13 arranged along a sheet feeding path 14. Sheets 16, 17, 18, 19, etc., have been or are being fed along the path 14 and selectively or alternatively into stacker 12, 13, etc. by a drive belt, part of which is seen at 21 as entraining the sheets in the path 14. Belt Drive means may be conventional and are thus shown only symbolically at 23 in FIG. 1. Also, the loading of the sheets onto the advancing drive belt 21 or in between such drive belt and a guide 24, may be effected and proceed in a conventional manner and is thus not specifically illustrated herein.

Stackers 12 and 13 have gates 25 and 26, respectively, each having a first position, shown for the gate 25, for guiding further sheets 19, etc., past that particular gate or stacking location, and having a second position, shown for the gate 26, for entering predetermined sheets, such as the sheet 18, into the particular stacker or stacking location. Each of the gates 25 and 26 thus can act as a means for guiding further sheets 19, etc., past a given stacking location in a first position of the particular gate, and also as a means for entering predetermined sheets into another stacking location in a second position of the gate or guiding means 25 or 26.

The expression "inbetween" has been provided to signify the concept of loading, positioning or advancing an object, such as a sheet 16, etc., into a space, interstice or location between two other objects, such as an advancing drive belt 21 and a guide 24.

Stacking or depositing devices 31 to 33 and 34 to 36 are located at a side of each stacker 12 and 13, respectively. As seen in the drawings, the sheet guiding means or gates 25 and 26, on the one hand, and the stacking or sheet depositing means or devices 31 to 33 and 34 to 36, respectively, on the other hand, are mounted independently of each other. In the stacking operation, the sheet depositing devices 31 through 33 or 34 to 36 are advanced into the stacking location for depositing entering sheets therein. For instance, the depositing devices 31 to 33 are simultaneously advanced into the stacking location 37 for depositing the first entering sheet 16 against a movable wall 38 and for depositing subsequent sheets 17, etc., in a similar manner until a stack 39 of deposited sheets is formed in the stacker 12 or stacking location 37.

According to the subject invention, the guiding of further sheets 19 past the stacking location 12 is mechanically slaved to the advancement of the stacking means or depositing devices 31 to 33 into the stacking location 37. This is believed to be a radical departure from prior-art proposals which controlled sheet entry gates and stacking means separately or which in effect would have used the sheet entry function or gate to control the stacking operation or means.

Details of preferred embodiments of the gate slaving system according to the subject invention are more fully described below with the aid of FIGS. 4 and 5. However, it may be noted at this point that the first sheet depositing device of each stacker, such as the device 31, carries a crank arrangement 41 that includes a crank pin 42 acting on an extension 43 of the gate 25, for instance, so as to close that gate upon initiation of a stacking operation in the particular stacker.

The advancing belt 21 may be backed up by rollers (not shown, but similar in appearance to the rotary component 23 in FIG. 1 of the drawings). One of these rollers may be positioned in the vicinity of each gate 25 and 26 in order to aid its sheet handling function.

As shown for the second stacker 13 in FIG. 1 the depositing devices 34 to 36 are withdrawn from the stacking location 44 preparatory to each stacking of a predetermined sheet 18 into that stacking location. According to an additional or alternative aspect of the subject invention, the guiding of the predetermined sheet 18 into the stacking location 44 is mechanically slaved to the withdrawal of the stacking or depositing devices 34 to 36. As more fully described below, that additional or alternative slaving also involves the crank pin 42 and cam pin 43 in the preferred embodiment illustrated in FIGS. 4 and 5 for the gate 25. Of course, the same applies to the gate 26 in the illustrated preferred embodiment. After the predetermined sheet 18 has fully passed through the open entry gate 26, that sheet is deposited in the stacking location 44 by advancement of the withdrawn stacking or depositing devices 34 to 36 into that stacking location.

According to the illustrated embodiments of the subject invention, the same slaving principle as already explained with respect to the gate 25 and depositing devices 31 to 33 is also applied to the second gate 26 and depositing devices 34 to 36. Accordingly, as soon as these devices 34 to 36 enter the stacking area 45 for depositing the fully entered sheet 18 therein, the slaved gate 26 is closed, such by means of a crank arrangement 41 shown in FIGS. 4 and 5, whereby any further sheets 19, etc., are then guided past the stacker 13 or stacking location 44 by the then closed second gate 26.

As seen in the drawings, the depositing devices 31 and 33, acting as stacking means, are angularly movable between the positions shown therefor at stackers 12 and 13, respectively. According to the illustrated preferred embodiment, angular movement of such depositing devices 31 to 33 and 34 to 36 is translated into movement of the corresponding gate 25 or 26 between its first and second positions shown at stackers 12 and 13, respectively.

The illustrated stacking or depositing means include a first shaft 45 for the depositing devices 31 to 33 and a second shaft 46 for the depositing devices 34 to 36.

Each of the shafts 45 and 46 extends along and represents a first axis about which the particular depositing devices 31 to 33 or 34 to 36 are angularly movable. The gate 25 is angularly movable about an axis realized and represented by a shaft 48, and the gate 26 is angularly movable about an axis realized and represented by a further shaft 49.

The axes or shafts 45 and 48 extend at an angle to each other, and the axes or shafts 46 and 49 similarly extend at an angle to each other. Accordingly, as may be explained with the aid of the first stacker 12, the depositing devices 31 to 33 are rendered angularly movable about a first axis, while the gate 25 is rendered angularly movable between its first and second positions about a second axis extending at an angle to the first axis, such as at a right angle in the illustrated preferred embodiment of the invention. Angular movement about the first axis is then translated into angular movement of the gate 25 about its second axis between the first and second gate positions, for guiding further sheets 19, etc., past the stacking location 37 and for entering predetermined sheets into the stacking location, respectively, as shown in FIG. 1 for the two stackers 12 and 13.

The gates 25 and 26 in the illustrated embodiments are biased to their second position for entering a predetermined sheet into either stacking location. A spring 51 acting on a cross member 52 may be employed for that purpose, as shown for the gate 25 in FIG. 4 and for the gate 26 in FIG. 1. While a leaf spring has been shown for that purpose, a helically coiled spring or any other biasing means that will do the job may be employed instead, as desired or necessary.

Angular movement of the depositing devices 31 to 33 or 34 to 36 is then translated into angular movement of the gate 25 or 26 against the bias of spring 51 from the second to the first gate position for guiding further sheets 19, etc., past the particular stacking location. This in practice makes for a particularly advantageous and rapid sheet stacking operation.

According to a further aspect of the illustrated prefered embodiment of the invention, the entered predetermined sheets 16, 17, 18, etc., are stacked against a wall 38 movable in the stacking location, by first effecting a withdrawal of the stacking or depositing devices 31 to 33 or 34 to 36 from the particular stacking location, preparatory to each stacking of a predetermined sheet. In order to further increase stacking speed and effectiveness, unobstructed spaces 54 and 55 are provided between each movable wall 38 and the withdrawn stacking devices 31 to 33 or 34 to 36. As indicated by dotted lines 57 in FIG. 1, each unobstructed space 54 and 55 serves the reception of each predetermined sheet guided to the stacking location 37 and 45, respectively. Each stacker has a ledge 58 or 59 for permanently preserving the unobstructed space 54 or 55 between the movable wall 38 and the withdrawn stacking devices.

In the initial position of the movable wall, such as when the stacking location is empty, the carriage 71 abuts the ledge 58 or 59 so that each sheet entering the stacking location will always enter an unobstructed space. This applies to the first sheet and to each subsequent sheet entering the stacking location.

In principle, the spaces 54 and 55 could be designated as permanently preserved free spaces. However, thin flexible flaps 61 to 63 and 64 to 66 have been shown as projecting into the otherwise free spaces 54 and 55, respectively, whereby entered sheets 18, etc. are prevented from creeping back to the entry gate area. The thin elastic elements 61 to 66 represent no obstruction, since they are angled in the direction of movement of the entering sheets 18, etc., and are easily pushed aside by an entering sheet, as shown for the first flexible element 64 in the second stacker 13.

Sheets entered into and received in any unobstructed space 54 and 55 are deposited against or in the direction of the movable wall 38 by advancing the withdrawn stacking or depositing devices 31 to 33 or 34 to 36 through the unobstructed space 54 or 55 for moving each received predetermined sheet toward the movable wall in the stacking location 37 or 44 so as to build up a stack 39 of predetermined sheets 16, 17, etc., against the wall 38 in the stacking location 37 or 45.

Figure 3:
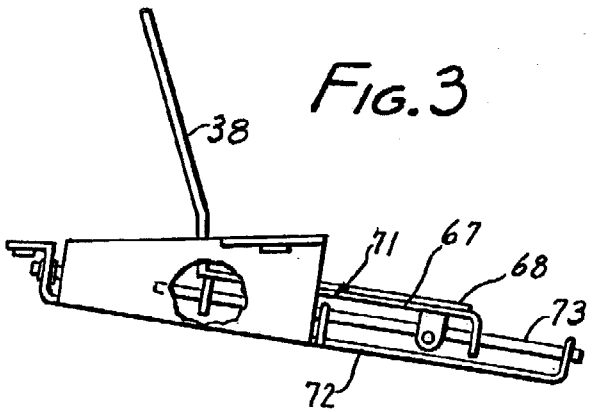
FIG. 3 is a side view of a carriage system taken essentially on the line 3—3 in FIG. 1.

The sheet stack 39 rests on a base 67 of the carriage, and high-friction areas 68 and 69 may be provided to prevent any of the sheets 16, 17, etc., from sliding from the carriage 71 under the ledge 58 or 59 during stacking. In a prototype of the illustrated embodiment strips of fastener material sold under the registered trademark VELCRO have been used at 68 and 69. In FIG. 3, the carriage 71 and wall 38 are shown as positioned upwardly against the force of gravity, as if a stack of sheets were deposited thereon, as partly shown at 39 in FIG. 1.

As shown specifically in FIG. 3, the movable wall 38 is an upwardly projecting part of a carriage 71 riding on a baseplate 72 along a guidance rod 73. In principle, a spring (not shown) could be employed to bias the carriage 71 toward the ledge 58 or 59. However, a downward slope of the baseplate 72 is preferred for that purpose. In this manner, the carriage is moved downwardly toward and against the ledge 58 or 59 and is then moved upwardly against the force of gravity by the advancing depositing devices 31 to 33 or 34 to 36 and the growing stack of sheets on the movable wall 38 and carriage or tray 71.

Figure 4:
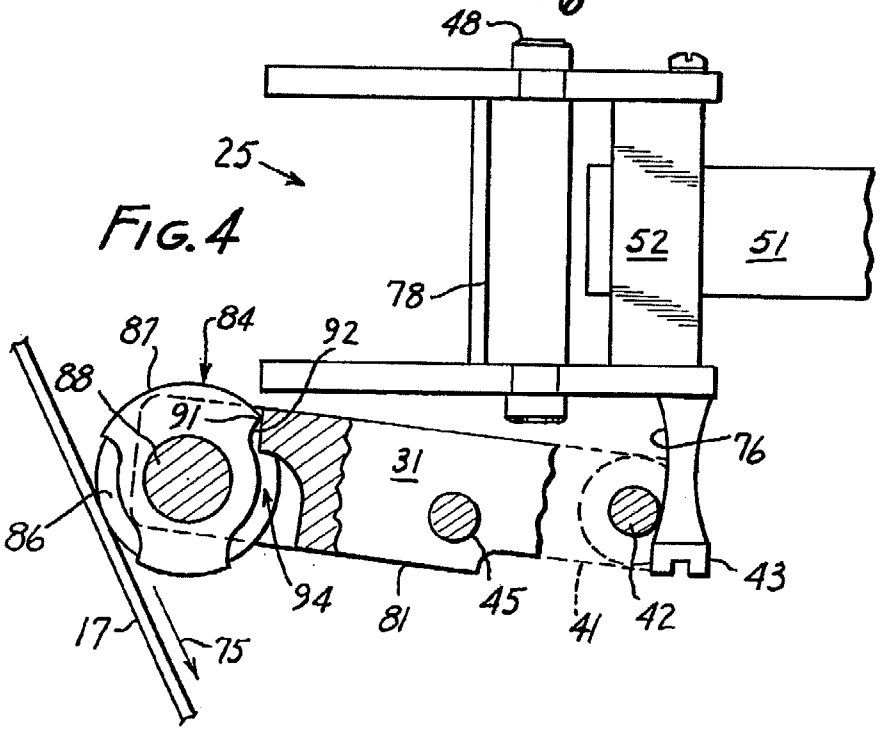
FIG. 4 is a view taken essentially on the line 4—4 in FIG. 1, on an enlarged scale, and with portions broken out for better visability of the remaining parts.
Figure 5:
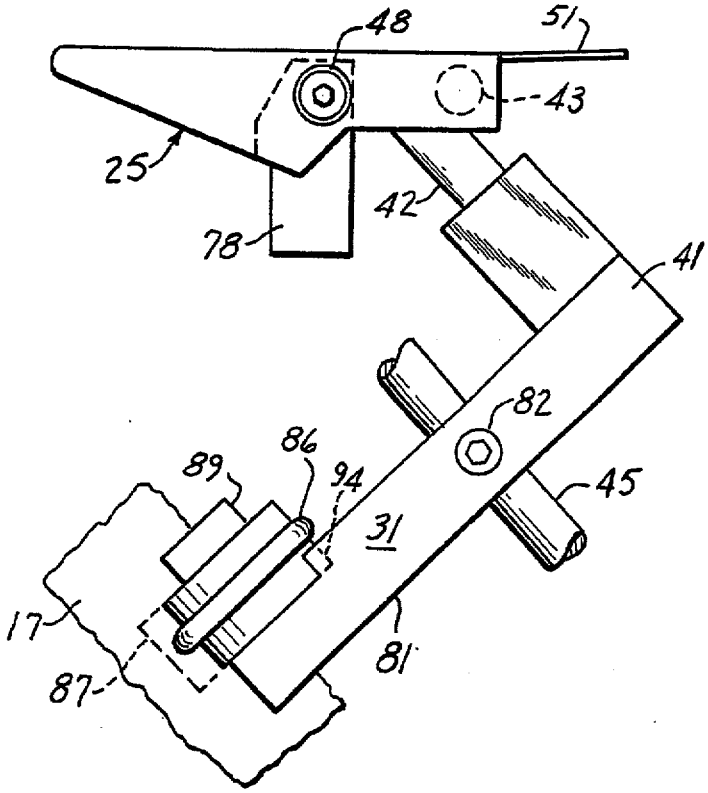
FIG. 5 is a top view of the assembly shown in FIG. 4.

As shown specifically in FIGS. 4 and 5, the presently preferred mechanical slaving or angular movement translating means include a crank arrangement 41 for angularly moving the guiding means or gate 25 or 26 about their axis or shaft 48 in response to angular movement of the depositing devices 31 to 33 or 34 to 36 about the axis of the drive shaft 45 or 46.

Within the scope of the subject invention, the crank arrangement 41 need not be integral with any of the sheet depositing devices, since there are various ways of mechanically slaving the gates 25 and 26 to the depositing devices 31 to 33 and 34 to 36, respectively. For instance, the crank pin 2 could otherwise be coupled to the depositing device drive shaft 45. However, according to the illustrated preferred embodiment of the invention, the crank pin 42 is mounted on the free end of an extension of the front end depositing device 31 for the stacker 12 or 34 for the stacker 13. Accordingly, if, say, the depositing device 31 rotates counterclockwise about the axis of the shaft 45, as seen in FIG. 4, then the crank pin 42 first strikes the bottom or lower free end of the downward pin or extension 43 of the gate 25, thereby angularly moving that gate counterclockwise, as seen in FIG. 5, as the sheet depositing device 31 keeps moving in the direction of the arrow 75.

This continues until the gate 25 has been actuated to its above mentioned first position in which a sheet 19 is guided past the stacking location 37, as shown in FIG. 1. In other words, the translating means or crank arrangement 41 angularly moves the guiding means or gate 25 about its second axis or shaft 48 in response to angular movement of the depositing devices 31, etc., about the axis of the shaft 45.

An optional embodiment within the scope of the subject invention introduces further flexibility in this respect, in case the needs of the stacker should be different as far as angular movements of the gates and depositing devices are concerned. For that case, the invention introduces a kind of lost motion connection between the angular movement of, say, the depositing device 31 and the gate 25. In the embodiment shown in FIG. 4, this is, for instance, implemented by including at the crank arrangement a section having a circular configuration 76, so that the crank pin follows that section or circular configuration after angular movement of the guiding means or gate 25 about its second axis has been completed for a given stacker configuration. In the specifically illustrated embodiment of FIG. 4, the downward gate pin has an hour-glass-shaped configuration for that purpose. However, that is not necessary in practice,- where a mere lost motion connection in the slaving of the gate to the sheet depositing devices is desired. For instance, the downwardly depending projection of the gate 25 could be formed by injection molding with the curvature 76 being only provided so as to face the crank pin 42, as further shown in FIG. 9.

In either case, once the crank pin 42 has come to ride on that circular section 76, no material further angular movement of the gate 25 takes place, since the circular configuration 76 is preferrably at least roughly concentric with the shaft 45. In other words, the circular configuration 76 extends substantially about the first axis of the shaft 45 for taking up angular movement of the depositing device 31 or crank arrangement 41 about that first axis, after movement of the guiding means or gate 25 about its second axis or shaft 48 to one of its first and second positions. As shown in FIGS. 4 and 5, the shaft 48 may actually be formed by screws threaded into a gate pivot block 78.

The depositing devices 31 to 36 include fingers 81 angularly movable about the first axis of the shaft 45 for depositing each entering sheet in its stacking location. In practice, the fingers 81 may be attached to the stacker drive shaft 45, as indicated by a screw 82 in FIG. 5. The crank arrangement 41 or other slaving means within the scope of the subject invention thus translate angular movement of the fingers 81 about the first axis into angular movement of the guiding means or gate 25 about the second axis between the first and second gate positions.

In the illustrated preferred embodiment of the invention, the depositing devices 31 to 36 include rollers 84 on the fingers 81 for engaging each entering sheet for deposition in its stacking location.

Each roller 84 has a tire 86 for engaging each entering sheet and moving the same downwardly in the direction of arrow 75 into the stacker, upon rotation of the shaft 45 and depositing device 31 or finger 81 in a counterclockwise direction, as seen in FIG. 4.

Each roller 84 also has a radial extension 87 surmounting part of the periphery of the tire 86. That tire 86 is of a high-friction material, such as rubber or an elastomer, while the radial projection 87 is of a low friction material, such as a thermoset plastic which has a lower friction than the tire 86. The roller 84 is rotatable about a shaft 88 which laterally projects from the free end of the finger 81 and which carries a cap 89 for retaining the roller 84 angularly movable at the free finger end.

The radially projecting portion or flange 87 has a shoulder or stop 91 for abutment with a projection 92 of finger 81. When the finger 81 is moving downwardly as seen in FIG. 4, the abutment at 91 and 92 maintains the high-friction tire 86 on the sheet 17, whereby that sheet is pushed into the stacking location. On the other hand, when the finger and roller 84 move upwardly during withdrawal of the devices 31 through 33 or 34 to 36 to their retracted position, then the roller 87 can rotate counterclockwise, as seen in FIG. 4, whereby the shoulder 91 will move away from the finger projection 92. In this manner, the low-friction radial projection 87 will move onto the deposited sheet 17, as indicated in dotted outline at 87 in FIG. 5.

The illustrated preferred embodiment of the invention thus establishes a lost-motion connection 94 or lag between roller 84 and finger 81 for preventing removal of any deposited sheet 17, etc., from the stacking location 37 or 44 by the roller 87.

Of course, when the depositing devices return from their retracted position shown at the stacker 13 to their advance position shown at the stacker 12, each advanced roller 84 will come into contact with the next sheet, whereby the roller will come to rotate until the tire 86 is in contact with that sheet and the lost-motion connection 94 is taken up, so that the sheet depositing devices will again move a sheet into the stacker in the direction of arrow 75 shown in FIG. 4.

Figure 2:
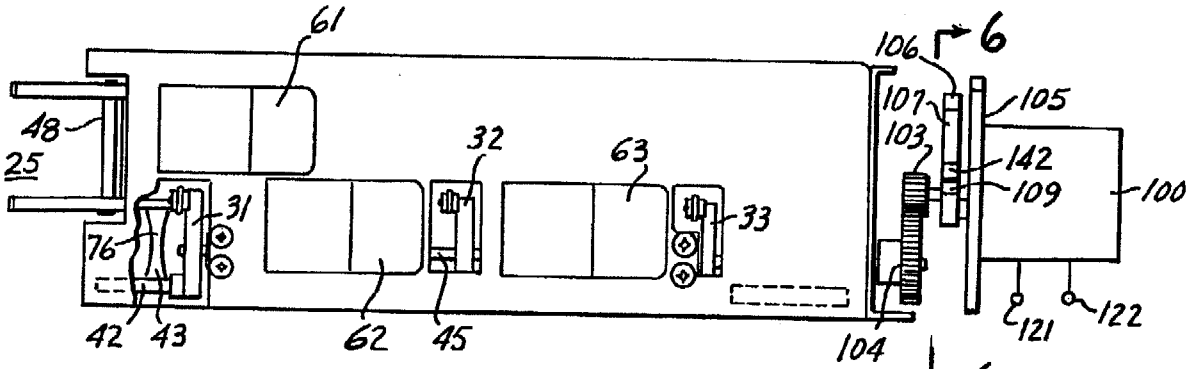
FIG. 2 is an elevation taken along the line 2—2 in FIG. 1, but showing a gate and stacking means in an alternative position.

In the illustrated preferred embodiment of the invention, the crank arrangement 41 or other slaving means are coupled to the shaft 45 for moving the guiding means or gate 25 or 26 between its first and second positions in response to angular movement of that shaft about its first axis. The stackers include means for driving the depositing devices 31 to 36 or the fingers 81 and the guiding means or gates 25 or 26 via the shaft 45. In the illustrated embodiments, these drive means include an electric motor 100 or 101 for each stacker 12 or 13. The motor drives a gear composed of a pinion 103 rotated by the motor shaft and a partially dented segment 104 attached to the stacker shaft 45 or 46. The motor 100 is mounted on a plate 105 which also carries a pair of stops 106 and 107 seen in FIGS. 2 and 6. The motor shaft 108 carries a radial projection 109 which alternatively engages either of the stops 106 and 107, depending on the direction of rotation of the motor 100 or 101. In other words, the stops 106 and 107 limit rotation of the pinion 103 and segment 104 so as to limit rotation of the stacker shaft 45 or 46 to angular movement between the withdrawn or retracted position of the depositing devices shown at 34 to 36 for the stacker 13 to the advanced position shown at 31 to 33 for the stacker 12 in FIG. 1.

In principle, limit switches or other electrical stops could be provided for de-energizing the motor 100 each time the depositing devices have reached their retracted position, as well as de-energizing the motor again, each time the depositing devices have reached their advanced position shown in FIG. 1 for the stacker 12. In practice, that conventional approach also has been an impediment to the attainment of higher document flows and stacking speeds.

Accordingly, the illustrated preferred embodiment employs a mechanical stopping arrangement with appropriate motor energizing circuitry, rendering bidirectional stopping on a mechanical basis possible.

Figure 7:
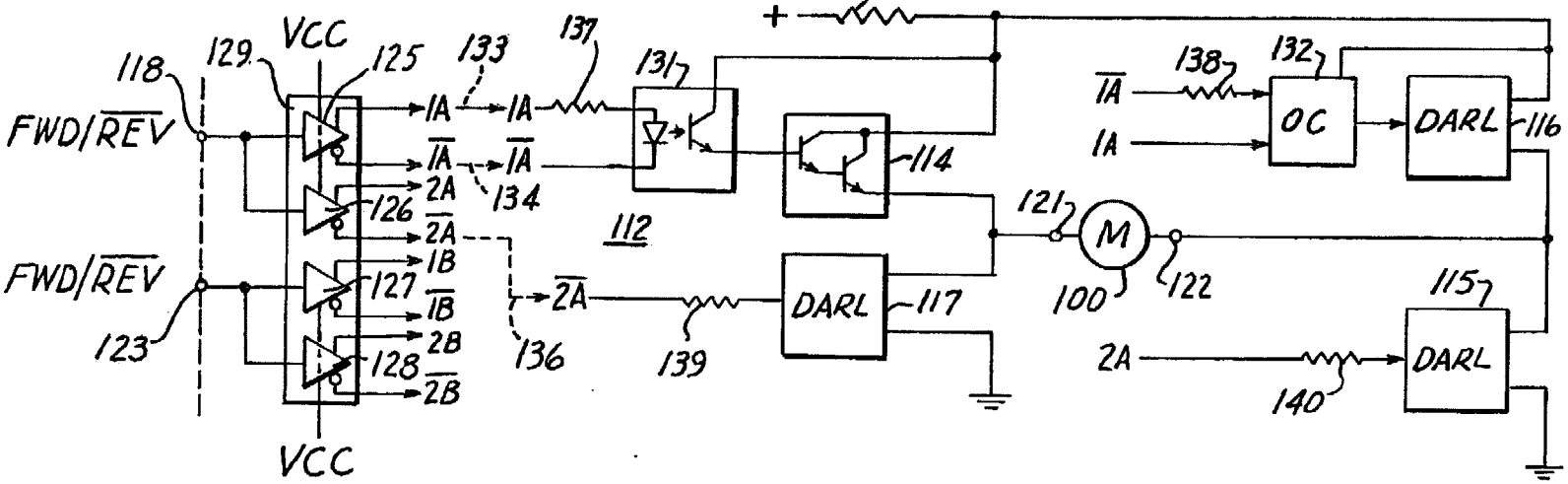
FIG. 7 is a block diagram and schematic of electric motor drive circuitry according to another embodiment of the subject invention that may be employed in the system of, FIGS. 1 to 6, or in other systems.

A preferred embodiment of the motor energizing circuitry 112 according to the subject invention is shown in FIG. 7. In that circuitry, the motor 100 is energized from a power source (not shown) through a resistor 113 and alternatively through Darlington circuits 114 and 115 or 116 and 117, depending on the state of forward and reverse command signals applied to a control input terminal 118. The motor 100 thus is of a permanent magnet field or other type that reverses its sense of rotation upon reversal of the polarity at its input terminals 121 and 122. In this respect, the circuitry 112 may be viewed as providing a pole reversal switch for alternatively rotating the motor 100 in a first sense of rotation and in an opposite second sense of rotation.

FIG. 7 also shows a control input terminal 123 for effecting alternative forward and reverse movement of the motor 101 of the second stacker 13.

The control signal input terminals 118 and 123 are connected to inputs of differential line drivers 125, 126, 127 and 128, respectively. By way of example, a quadruple differential line driver 129 of the Type MC3487 as described, for instance, in the Line Driver and Line Receiver Data Book, by Texas Instruments Inc. (1981) pp. 57 to 60 may be employed in the circuitry shown in FIG. 7.

That circuitry 112 also includes optocouplers or optical couplers 131 and 132 connected as shown by dotted lines 133 and 134, and also by symbols 1A and $\overline{1A}$ at the output of the driver 125 and the inputs of optocouplers 131 and 132.

FIG. 7 shows a schematic diagram for the optocoupler 131, but only a block diagram for the optocoupler 132, since the two may be identical in design.

For increased current gain, the Darlington circuits 114 and 116 are connected to outputs of the optocouplers 131 and 132, respectively.

As indicated by the symbol 2A, the input of the Darlington circuit 115 is connected to an output of the driver 126. Conversely, the input of the Darlington circuit 117 is connected to the opposite-output of the driver 126, as indicated by the symbol $\overline{2A}$ and also by a dotted line 136. Optocoupler and Darlington circuit inputs may be provided with the usual series resistors 137, 138, 139 and 140, respectively. Also, the Darlington circuits 114 to 116 may be of identical design.

Figure 6:
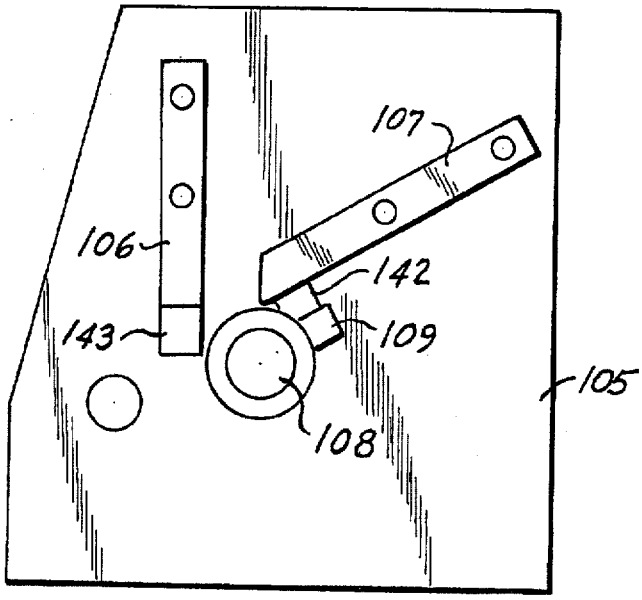
FIG. 6 is a view taken on the line 6—6 in FIG. 2.

Upon receipt of a forward command signal through input 118, and drivers 125 and 126, the optocoupler 131 and Darlington circuits 114 and 115 cause the motor 100 to be electrically energized through the resistors 113 and terminals 121 and 122 to drive the motor shaft 108 for instance in a counterclockwise direction as seen in FIG. 6, whereby the sheet depositing devices 31 and 36 are advanced into the stacker 12 via gear wheels 103 and 104 and shaft 45. At the same time, the gate 25 is closed via crank arrangement 41 or other means for slaving the gate 25 to the stacking devices 31 to 33.

Upon completion of that closure of gate 25 and advancement of the stacking devices 31 to 33, the radial projection 109 impinges upon a preferably elastomeric projection 142 of the stop 107. In this respect, it may be noted from FIG. 7 that, according to the illustrated preferred embodiment of the subject invention, there are no limit switches or other devices that would interrupt the motor current at that point. Rather, the circuity 112 keeps energizing the motor 100 even when the motor shaft projection 109 has impinged upon the stop 107 or its projection 142.

Upon receipt of a reverse command through control input terminal 118 and drivers 125 and 126, the second optocoupler 132 and Darlington circuits 116 and 117 cause a reversal of the motor energizing current which, in turn, causes the motor 100 to reverse its direction of rotation.

Accordingly, the motor shaft 108 now rotates clockwise, as seen in FIG. 6, until its radial projection 109 impinges upon the preferably elastomeric projection 143 of the second stop 106. Again, no limit switch or other device is employed for interrupting the electric motor energizing current at that point. Rather, current continues to flow through the motor 100, even though the stacker entry gate 25 is now open and the stacking devices 31 to 33 are now withdrawn, as shown for the entry gate 26 and stacking devices 34 to 36 in FIG. 1.

In a prototype of the stackers according to the subject invention, the motor 100 was of a type designed for 28 volts operating voltage. The supply current resistor 113 was 5 ohms, and the actual voltage across motor input terminals 121 and 122 was about 5 volts.

Circuitry identical or similar to the circuitry 112 shown in FIG. 7 may be provided for driving and energizing the motor 101 of the second stacker 113, except that such further circuitry is driven through terminals 1B, $\overline{1B}$, 2B and $\overline{2B}$ of drivers 127 and 128, receiving forward and reverse command signals through the common input terminal 123.

The illustrated preferred embodiment of the subjection invention provides an electric motor 100 with the first mechanical stop and with an opposite second mechanical stop 106, 107, and couples that motor to the stacking means or devices 31 to 33. Withdrawal of these stacking means or devices from the stacking location preparatory to each stacking of a predetermined sheet is effected by energizing the motor for rotation in a first sense whereby the motor reaches the first stop. Conversely, the motor is energized for rotation in an opposite second sense for depositing the guided predetermined sheet in the stacking location by advancement of the withdrawn stacking means or devices into that stacking location until the motor has reached the second stop.

In that combination of steps or features, the guiding of the predetermined sheet into the stacking location may again be mechanically slaved to the withdrawal of the stacking means or devices, while any of the further sheets may be guided past the particular stacking location, as explained above in connection with FIGS. 1 to 5.

As shown in FIG. 7, the energizing circuity 112 for the stacker motor includes means or circuits 114 to 117 for continuing energization of the motor 100 after either of the first and second stops 106 and 107 have been reached. In the illustrated preferred embodiment of the invention, the same applies to the second stacker motor 101 and to the drive for any other of as many stackers as may be employed in a given apparatus or terminal.

The electric motor system with mechanical stops and continued electric energization after either of these stops have been reached, may also be employed according to the subject invention in other kinds of stackers or in other apparatus, for that matter.

Accordingly, the currently discussed aspect of the invention resides in methods and apparatus for driving any load in opposite first and second directions, respectively, with an electric motor for driving that load. The electric motor, such as the above mentioned motor 100, is provided with a first mechanical stop and with an opposite second mechanical stop as shown, for instance, at 106, 143, 107 and 142 in FIG. 6. The motor is coupled to the load, such as via a gear 103, 104.

The circuitry 112 shown in FIG. 7, or an equivalent thereof, such as a power amplifier having an output controllable over positive and negative ranges, energizes the motor for rotation in a first sense so as to drive the load in one of the first and second directions until the motor has reached the first stop, and alternatively energizes the motor for rotation in an opposite second sense so as to drive the load in the other of the first and second directions until the motor has reached the second stop. As before, energization of the motor 100, 101, etc. is continued after either of the first and second stops 142 and 143 have been reached.

This use of an electric motor is superior to the employment of a solenoid for actuation of the gates and stackers or for actuation of any similar load. Solenoids inherently provide a relatively low force at the beginning and a high force at the end of each actuation stroke. This is inevitable, since magnetic field strength diminishes as a cubic function of distance. However, this is just the opposite of what is needed to actuate the type of loads herein disclosed.

Solenoids also introduce electric noise spikes into their electrical energizing systems. These spikes frequently affect the performance of control and other circuits involved in the operation of a system.

Use of a rotary motor according to the preferred embodiments of the subject invention avoids these drawbacks. Also, the avoidance of limit and end switches according to the currently discussed aspect of the subject invention prevents occurence of the type of electrical noise spikes and other interference generated by such devices.

Figure 8:
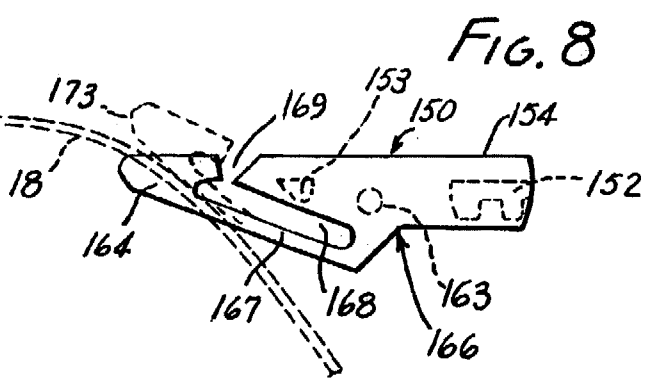
FIG. 8 is a top view of a sheet gate according to a preferred embodiment of the invention which may be employed in the stacking system of FIGS. 1 to 7.
Figure 9:
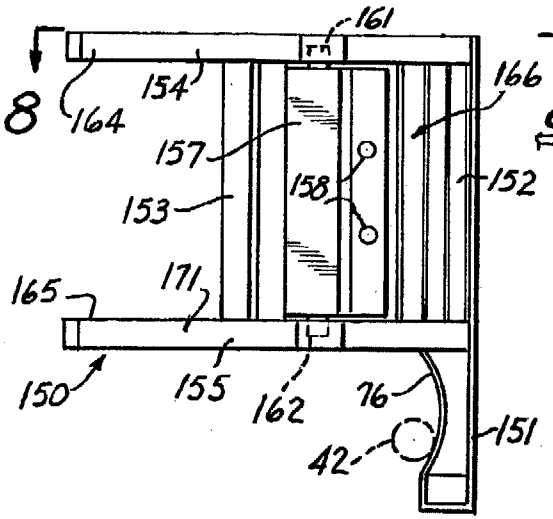
FIG. 9 is an elevation of the sheet gate of FIG. 8.

Either of the gates 25 and 26 shown in FIGS. 1, 2, 4 and 5 may be replaced by the gate 150 shown in FIGS. 8 and 9. In the context of the illustrated preferred embodiment of the invention, the gate 150 is also provided with a first position for guiding the further sheets past the particular stacking location, and with a second position for entering the predetermined sheets into the particular stacking location as shown, for instance, in FIG. 1 for the gates 25 and 26. The gate 150 is also moved between these first and second positions, such as by means of the crank arrangement 41 shown in FIGS. 4 and 5 and having the crank pin 42 shown also in FIG. 9.

As already mentioned above with respect to gates 5 and 26, the gate 150 has a downwardly extending projection 151 which provides the circular configuration or cam 76 followed by the crank pin 42 in a lost motion connection upon actuation of the gate. If desired, the hour-glass-shaped design shown at 43 in FIG. 4 could be used instead, but the configuration illustrated at 151 in FIG. 9 is generally preferred for injection molded parts.

The gate 150 has a cross member 152 which may have the same function as the cross member 52 engaged by the leaf spring 51 as shown in FIG. 4, for instance. The cross member 152 and another cross piece 153 mount two gate members 154 and 155 in a mutually spaced relationship.

In the illustrated preferred embodiment, the gate members 154 and 155 extend horizontally, while the cross pieces 152 and 153 extend vertically. In general terms, the cross pieces 152 and 153 essentially extend at right angles to the gate members 154 and 155, as does the cam projection 151. The spaced gate members 154 and 155 are mutually aligned in a vertical direction or, generally, in the direction of the cross pieces 152 and 153, so that only the top gate member 154 is visible in the top view of FIG. 8.

The gate 150 may be mounted on a centerpiece 157 which may be attached to stationary structure, as desired. By way of example, the centerpiece 157 may be attached to the sheet guide structure 24 at the stacker 12 or 13, by suitable fasteners 158.

The gate 150 is pivoted for angular movement on the centerpiece 157. Projecting dowels 161 and 162 may be employed for that purpose. For instance, the dowel 161 may project from the centerpeice 157 into an aperture 163 provided for that purpose in the gate member 154. A similar pivoting aperture may be provided in the second gate member 155 for the projecting dowel 162. The gate members 154 and 155 may be made sufficiently flexible for a snap-on arrangement. For instance, the dowels 161 and 162 may have slanted tops (not shown) to permit the gate 150 to be snapped thereonto.

According to the preferred embodiment of the invention illustrated in FIGS. 8 and 9, the gate 150 is provided with a flexible tip portion 164 for preventing damage to a sheet entering the stacking location while the gate is moving from its second position to its first position. In the design shown in FIGS. 8 and 9, the flexible tip portion is duplicated, in that a first flexible tip portion 164 is provided for the first gate member 154, and a second flexible tip portion 165 is provided for the second gate member 155. However, only the first flexible tip portion 164 is described in greater detail, since the two flexible tip portions 164 and 165 typically are identical in design and are aligned vertically or in the longitudinal direction of the cross pieces 152 and 153.

Broadly speaking, the gate 150 has a main portion 166 coupled to the cam 76 or other means 42, 151, etc. for moving the gate between its first and second positions and resilient supporting means, such as a rib or spar 167 projecting from the main portion 166 and resiliently supporting the flexible tip portion 164 relative to that main portion. In practice, the spar 167 may be realized by providing the gate member 154 with an elongate aperture 168 extending at an angle to a longitudinal extent of the gate member 154, and by a gap 169 issuing laterally into the elongate aperture 168.

In practice, the gate 150 may be injection molded of a synthetic material that has a sufficient elasticity upon curing for the tip portions 164 and 165 to be flexible relative to the main portion 166. In the illustrated embodiment, it is the spar 167 for the tip portion 164 and a like spar 171 for the tip portion 165 which render these gate tip portions flexible or resilient relative to the gate main portion 166.

Generally speaking, the gate 150 is suitable for methods and apparatus for selectively guiding predetermined sheets to a predetermined location and further sheets past that predetermined location, as described above and shown in FIG. 1 for gates 25 and 26, by way of example, but not by way of limitation. As there shown, the gate is provided with a first position for guiding the further sheets past the predetermined location, and with a second position for entering the predetermined sheets into the predetermined location, such as into the stacker 13 shown in FIG. 1. The gate 150 is moved between first and second positions so that sheets are alternatively guided to the predetermined location or guided past that location, as desired for different sheets.

In the case of the embodiment shown in FIG. 1, the control of each stacker motor has to be accurate, so that neither of the gates 25 and 26 closes upon an entering sheet. For instance, the open gate 26 must not close upon the sheet 18 while that sheet is entering the stacker 13.

On the other hand, certain tolerances are permitted in this respect by equipment of the gate with a flexible tip. Explaining this principle with the aid of the gate tip 164, dotted lines 173 show in FIG. 8 how the resilient spar 167 will bend and permit the gate tip portion 173 to flex out of the way of an incoming sheet 18. Accordingly, even if premature closure of the gate 150 at that point may somewhat depress the entering sheet 18 from its normal path, such sheet still may continue to enter the stacker or other predetermined location without being damaged by the prematurely closing gate.

After the belt 21 has finished driving the sheet 18 into the stacker 13, the flexed tip 173 of the gate 150 will fling or flick the trailing edge of the sheet 18 into the stacker and will thus assume the solidly illustrated position shown for the gate tip 164 in FIG. 8.

In the illustrated preferred embodiment of the invention, sheets of various sizes become in effect stacked evenly along walls 181 and 182 mounted at the stackers 12 and 13 by cross pieces 183 and 184, respectively. One reason for this advantageous uniform stacking of sheets of different heights, lengths and thicknesses arises from the fact that the illustrated embodiments of the invention constitute low-inertia systems, in which the sheets are not flung longitudinally into the stacker to impinge upon an alignment wall at the far end of the stacking location. To the contrary, the flexible members 61 to 66 are capable of absorbing whatever inertia any entering sheet has, so that the entering sheets align themselves along the stacker walls 181 and 182 without any need for a reverse drive previously needed for that purpose.

Utility of the gating and motor drive systems of the invention herein disclosed is not limited to a particular kind of stacker. For instance, instead of stacking the sheets on a moving carriage 71 or against a moving wall 38, it is possible to deposit the sheets downwardly on top of each other.

The subject extensive disclosure will suggest or render apparent to those skilled in the art various modifications and variations within the spirit and scope of the disclosed invention and equivalents thereof.

We claim:

1. In a method of stacking predetermined sheets of various intermixed sizes in a stacking location by advancement of stacking means into said stacking location, and of selectively guiding further sheets with guiding means past the stacking location, the improvement comprising the steps of:

mounting said stacking means indepenedently of said guiding means; and mechanically slaying said guiding means for a guiding of further sheets past the stacking location to said advancement of stacking means into the stacking location.

2. A method as claimed in claim 1, including the steps of:

providing said further sheets past said sticking location with the said of said gate having a first position for guiding said further sheets past the stacking location and having a second position for entering said predetermined sheets into the stacking location;

deposition each entering sheet in said stacking location with angularly movable depositing means as said stacking means; and translating angular movement of said depositing means into movement of said gate between said first and second positions.

3. A method as claimed in claim 2, including the steps of:

biasing said gate to said second position; and translating angular movement of said depositing means into angular movement of said gate from said second to said first position for guiding said further sheets past the stacking location.

4. A method as claimed in claim 1, including the steps of:

providing a gate as said guiding means for guiding said further sheets past said stacking location;

moving said gate between a first position for guiding said further sheets past the stacking location and a second position for entering said predetermined sheets into the stacking location; and providing said gate with a flexible tip portion for preventing damage to a sheet entering said stacking location while said gate is moving from said second position to said first position.

5. In a method of stacking predetermined sheets of various intermixed sizes in a stacking location by advancement of stacking means into said stacking location, and of selectively guiding further sheets past the stacking locating, the improvement comprising the steps of:

mechanically slaving said guiding of further sheets past the stacking location to said advancement of stacking means into the stacking location;

effecting a withdrawal of said stacking means from said stacking location preparatory to each stacking of a predetermined sheet;

mechanically slaving a guiding of said predetermined sheet into said stacking location to said withdrawal of the stacking means; and depositing said guided predetermined sheet in said stacking location by advancement of said withdrawn stacking means into said stacking location, while guiding any of said further sheets past said stacking location.

6. In a method of stacking predetermined sheets of various intermixed sizes in a stacking location by advancement of stacking means into said stacking location, and of selectively guiding further sheets past the stacking location, the improvement comprising the steps of:

mechanically slaving said guiding of further sheets past the stacking location to said advancement of stacking means into the stacking location;

rendering said depositing means angularly movable about a first axis;

rendering said gate angularly movable between said first and second positions about a second axis extending at an angle to said first axis; and translating angular movement of said depositing means about said first axis into angular movement of said gate about said second axis between said first and second positions for guiding said further sheets past the stacking location and for entering said predetermined sheets into the stacking location, respectively.

7. In a method of stacking predetermined sheets of various intermixed sizes in a stacking location by advancement of stacking means into said stacking location, and of selectively guiding further sheets past the stacking location, the improvement comprising the steps of:

mechanically slaving said guiding of further sheets past the stacking location to said advancement of stacking means into the stacking locations;

providing said stacking means with roller means for engaging and depositing each predetermined sheet in said stacking location; and providing said roller means with a lag or lost motion for preventing removal of any deposited predetermined sheet from said stacking location upon movement of said stacking means preparatory to engagement and deposition of a subsequent predetermined sheet in said stacking location.

8. In a method of stacking predetermined sheets of various intermixed sizes in a stacking location by advancement of stacking means into said stacking location, and of selectively guiding further sheets past the stacking location, the improvement including the steps of:

mechanically slaving said guiding of further sheets past the stacking location to said advancement of stacking means into the stacking location;

stacking said predetermined sheets against a wall movable in said stacking location by:

effecting a withdrawal of said stacking means from said stacking location preparatory to each stacking of a predetermined sheet;

providing and permanently preserving between said movable wall and said withdrawn stacking means an unobstructed space for receiving each predetermined sheet guided to said stacking location; and depositing said received predetermined sheets against said movable wall by advancing saids withdrawn stacking means through said obstructed space for moving each received predetermined sheet toward said movable wall in said stacking location eo as to build up a stack of predetermined sheets against said wall in the stacking location.

9. In a method of stacking predetermined sheets of various intermixed sizes in a stacking location by advancement of stacking means into said stacking location, and of selectively guiding further sheets past the stacking location, the improvement comprising the steps of:

mechanically slaving said guiding of further sheets past the stacking location to said advancement of stacking means into the stacking location;

providing an electric motor with a first mechanical stop and with an opposite second mechanical stop;

coupling said motor to said stacking means;

effecting a withdrawal of said stacking means form saids stacking location preparatory to each stacking of a predetermined sheet by energizing said motor for rotation in a first sense whereby said motor reaches the first stop;

mechanically slaving a guide of said predetermined sheet into said stacking location to said withdrawal of the the stacking means; and energizing said motor for rotation in an opposite second sense for depositing said guided predetermined sheet in said stacking location by advancement of said withdrawn stacking means into said stacking location until said motor has reached the second stop, while guiding any of said further sheets past said stacking location.

10. A method as claimed in claim 9, including the steps of:

guiding said further sheets past said stacking location with the aid of a gate having a first position for guiding said further sheets past the stacking location and having a second position for entering said predetermined sheets into the stacking location;

electrically biasing said gate to said first position with said electric motor;

depositing each entering sheet in said stacking location with angularly movable depositing means as said stacking means;

activating said depositing means with said electric motor; and translating angular movement of said depositing means into movement of said gate between said first and second positions.

11. In a method of stacking predetermined sheets of various intermixed sizes with stacking means in a stacking location, and of selectively guiding further sheets with guiding means past the stacking location, the improvement comprising in combination the steps of:

mounting said stacking means independently of said guiding means;

effecting a withdrawal of said stacking means from said stacking location preparatory to each stacking of a predetermined sheet;

mechanically slaving said guiding means for a guiding of said predetermined sheet into said stacking withdrawal of the stacking means; and depositing said predetermined guided sheet in said stacking location by advancing said withdrawn stacking means into said stacking location.

12. A method as claimed in claim 11, including the steps of:

providing an electric motor with a first mechanical stop and with an opposite second mechanical stop;

coupling said motor to said stacking means;

effecting said withdrawal of said stacking means by energizing said motor for rotation in a first sense whereby said motor reaches the first stop;

advancing said stacking means into said stacking location by energizing said motor for rotation in an opposite second sense whereby said motor reaches said second stop; and continuing energization of said motor even when said motor has reached either of said stops.

13. In a method of selectively guiding predetermined sheets to a predetermined location and further sheets past said predetermined location, the improvement comprising in combination the steps of:

providing a gate with a first position for guiding said further sheets past said predetermined location, and with a second position for entering said predetermined sheets into said predetermined location;

pivotally mounting said gate for angular movement between said first and second positions;

angularly moving said gate between said first and second positions; and providing said gate with a flexible tip portion for preventing damage to a predetermined sheet entering said predetermined location while said gate is angularly moved form said second position to said first position, by providing the gate with an elongate aperture extending at an angle to a longitudinal extent of said gate and with a gap issuing laterally into the elongate aperture to realize a spar projecting from a main portion of the gate for resiliently supporting the flexible tip.

14. In apparatus for stacking predetermined sheets of various intermixed lengths in a stacking location and for selectively guiding further sheets past the stacking locations, the improvement comprising in combination:

means for guiding said further sheets past the stacking location in a first position of said guiding means and for entering said predetermined sheets into the stacking location in a second position of said guiding means;

selectively movable means at the stacking location for deposition each entering sheet in the stacking location;

means for mounting saisd guiding means and said depositing means independently of each other; and means for mechanically slaving movement of said guiding means between said first and second positions to movement of said depositing means.

15. Apparatus as claimed in claim 14, including:

means for mounting said depositing means for angular movement at the stacking location; and said slaving means including means coupled to said guiding means and said depositing means for translating angular movement of said depositing means into movement of said guiding mean between said first and second positions.

16. Apparatus as claimed in claim 14, wherein:

said depositing means include finger means angularly movable about a first axis for depositing each entering sheet in the stacking location.

17. Apparatus as claimed in claim 14, wherein:

said depositing means include a shaft angularly movable about a first axis and finger means located on said shaft;

said slaving means include means coupled to said shaft for moving said guiding means between said first and second positions in response to angular movement of said shaft about said first axis; and said apparatus includes means for driving said finger means and said guiding means via said shaft.

18. Apparatus as claimed in claim 14, including:

electric motor means for effecting a withdrawal of said depositing means from said stacking location preparatory to each stacking of a predetermined sheet and for depositing said guided predetermined sheet in said stacking location by advancement of said withdrawn depositing means into said stacking location;

a first mechanical stop and an opposite second mechanical stop for said motor means; and means for energizing said motor means for rotation in a first sense so as to effect said withdrawal of said depositing means whereby the motor means reach the first stop, and for alternatively energizing said motor means for rotation in an opposite second sense so as to effect said advancement of the withdrawn depositing means whereby the motor means reach the second stop.

19. Apparatus as claimed in claim 18, wherein:

said energizing means include means for continuing energization of said motor means after either of said first and second stops have been reached.

20. Apparatus as claimed in claim 14, wherein:

said guiding means include a gate having said first position for guiding said further sheets past the stacking location, and having said second position for entering said predetermined sheets into the stacking location, and means for moving said gate between said first and second positions; and said gate has a flexible tip portion for preventing damage to a sheet entering the stacking location while said gate is moving from said second position to said first position.

21. Apparatus as claimed in claim 20, wherein:

said gate has a main portion coupled to said means for moving said gate between said first and second positions, and resilient supporting means projecting from said main portion and resiliently supporting said flexible tip portion relative to said main portion.

22. In apparatus for stacking predetermined sheets of various intermixed lengths in a stacking location and for selectively guiding further sheets past the stacking location, the improvement comprising in combination:

means for guiding said further sheets past the stacking location in a first position of said guiding means and for entering said predetermined sheets into the stacking location in a second position of said guiding means;

selectively movable means at the stacking location for depositing each entering sheet in the stacking location;

means for mechanically slaving movement of said guiding means between said first and second positions to movement of said depositing means; and means for effecting a withdrawal of said depositing means from saids stacking location preparator to each stacking of a predetermined sheet and for depositing said guided predetermined sheet in said stacking location by advancement of said withdrawn depositing means into said stacking location;

said slaying means including means for mechanically slaving said entering of said predetermined sheets into said stacking location to said withdrawal of the depositing means.

23. Apparatus as claimed in claim 22, wherein:

said shaving means including means for mechanically slaving said guiding of said further sheets past said stacking location to said advancement of the depositing means into the stacking location.

24. In apparatus for stacing predetermined sheets of various intermixed lengths in a stacking location and for selectively guiding further sheets past the stacking location, the improvement comprising in combination:

means for guiding saids further sheets past the stacking location in a first position of said guiding means and for entering said predetermined sheets into the stacking location in a second position of said guiding means;

selectively movable means at the stacking location for depositing each entering sheet in the stacking location;

means for mechanically slaving movement of said guiding means between said first and second positions to movement of said depositing means; and means for effecting an advancement of said depositing means into saisd stacking location for deposition of each entered predetermined sheet in said stacking location;

said slaving means including means for mechanically slaving movement of said guiding mean as to said first position to said advancement of the depositing means.

25. In apparatus for stacking predetermined sheets of various intermixed lengths in a stacking location and for selectively guiding further sheets past the stacking location, the improvement comprising in combination:

means for guiding said further sheets past the stacking location in a first position of said guiding means and for entering said predetermined sheets into the stacking location in a second position of said guiding means; location selectively movable means at the stacking for depositing each entering sheet in the stacking location; for angular means for mounting said depositing means movement at the stacking location about a first axis;

said guiding means are angularly movable between said first and second positions about a second axis extending at an angle to said first axis;

means for mechanically slaving movement of said guiding means between said first and second positions to movement of said depositing means;

said slaving means including means coupled to said guiding means and said depositing means for translating angular movement of said depositing means into movement of said guiding means between said first and second positions; and ing said translating means including means for translate angular movement of said depositing means about said first axis into angular movement of said guiding means about saisd second axis between said first and second positions.

26. Apparatus as claimed in claim 25, wherein:

said second axis extends at right angles to said first axis.

27. In apparatus for stacking predetermined sheets of various intermixed lengths in a stacking location and for selectively guiding further sheets past the stacking location, the improvement comprising in combination:

means for guiding said further sheets past the stacking location in a first position of said guiding means and for entering said predetermined sheets into the stacking location in a second position of said guiding means;

selectively movable means at the stacking location for depositing each entering sheet in the stacking location;

means for mounting said depositing means for angular movement at the stacking location about a first axis;

said guiding means are angularly movable between said first and second positions about a second axis extending at an angle to said first axis; and means for mechanically slaving movement of said guiding means between said first and second positions to movement of said depositing means, said slaving means including means coupled to said guiding means and said depositing means for translating angular movement of said depositing means into movement of said guiding means between said first and second positions;

said translating means including a crank arrangement for angularly moving said guiding means about said second axis in response to angular movement of said depositing means about said first axis.

28. Apparatus as claimed in claim 27, wherein:

said crank arrangement includes a section having a circular configuration and means for following said section after angular movement of said guiding means about said second axis.

29. Apparatus as claimed in claim 28, wherein:

said translating means include means having a circular configuration extending substantially about said first axis for taking up angular movement of said crank arrangement about said first axis after movement of said guiding means about said second axis to one of said first and second positions.

30. Apparatus as claimed in claim 29, wherein:

said second axis extends at right angles to said first axis.

31. In apparatus for stacking predetermined sheets of various intermixed lengths in a stacking location and for selectively guiding further sheets past the stacking location, the improvement comprising in combination:

means for guiding said further sheets past the stacking location in a first position of said guiding means and for entering said predetermined sheets into the stacking location in a second position of said guiding means;

selectively movable means at the stacking location for depositing each entering sheet in the stacking location; and means for mechanically slaving movement of said guiding means between saids first and second positions to movement of said depositing means;

said depositing means include finger means angularly movable about a first axis for depositing each entering sheet in the stacking location;

said guiding means are angularly movable between said first and second positions about a second axis extending at an angle to said first axis; and said lsavin means include means for translating angular movement of said finger means about said first axis into angular movement of said guiding means about said second axis between said first and second positions.

32. In apparatus for stacking predetermined sheets of various intermixed lengths in a stacking location and for selectively guiding further sheets past the stacking location, the improvement comprising in combination:

means for guiding said further sheets past the stacking location in a first position of said guiding means and for entering said predetermined sheets into the stacking location in a second position of said guiding means;

selectively movable means at the stacking location of depositing each entering sheet in the stacking location;

means for mechanically slaving movement of said guiding means between said first and second positions to movement of said depositing means;

said depositing means include a shaft angularly movable about a first axis and finger means located on said shaft;

said slaving means include means coupled to said shaft for moving said guiding means between said first and second positions in response to angular movement of said shaft about said first axis;

said apparatus includes means for driving said finger means and said guiding means via said shaft; and;

said depositing means include roller means on said finger means for engaging each entering sheet for deposition in the stacking location, and a lost-motion connection between said roller means and the finger means for preventing removal of any deposited predetermined sheet from the stacking location by said roller means.

33. In apparatus for stacking predetermined sheets of various intermixed lengths in a stacking location and for selectively guiding further sheets past the stacking location, the improvement comprising in combination:

means for guiding said further sheets past the stacking location in a first position of said guiding means and for entering said predetermined sheets into the stacking location in a second position of said guiding means;

selectively movable means ath the stacking location for depositing each entering sheet in the stacking location, said depositing means including angularly movable finger means and roller means on said finger means for engaging each entering sheet for deposition in the stacking location; and means for mechanically slaving movement of said guiding means between said first and second positions to movement of said depositing means.

34. Apparatus as claimed in clam 33, including:

a lost-motion connection between said roller means and said finger means for preventing removal of any deposited predetermined sheet from the stacking location by said roller means.

35. In apparatus for stacking predetermined sheets of various intermixed lengths in a stacking location and for selectively guiding further sheets past the stacking location, the improvement comprising in combination:

means for guiding said further sheets past the stacking location in a first position of said guiding means and for entering said predetermined sheets into the stacking location in a second position of said guiding means;

means for supporting stacking sheets including a wall movable in said stacking location;

selectively movable means at the stacking location for depositing each entering sheet in the stacking location;

means for effecting withdrawal of said depositing means from said stacking location preparatory to each stacking of a predetermined sheet;

means for providing and permanently preserving between said movable wall and said withdrawn stacking means an unobstructed space for receiving each predetermined sheet guided to said stacking location;

means combined with saids withdrawal means for advancing said withdrawn depositing means through said unobstructed space for moving each received predetermined sheet toward said movable wall in said stacking location so as to build up a stack of predetermined sheets against said wall in the stacking location; and means for mechanically slaving movement of said guiding means between said first and second positions to movement of said depositing means.

36. In apparatus for selectively guiding predetermined sheets to predetermined and further sheets past said predetermined location, the improvement comprising in combination;

a gate having a first position for guiding said further sheets past said predetermined location, and having a second position for entering said predetermined sheets into said predetermined location;

means for moving said gate between said first and second positions; and means for preventing damage to a predetermined sheet entering said predetermined location while said gate is moving from said second position to said first position, including a flexible tip portion on said gate position to contact said entering sheet;

said gate having a main portion coupled to said means for moving said gate between said first and second positions, and a resilient supporting spar projecting from said main portion and resiliently supporting said flexible tip portion relative to said main portion, said gate having an elongate aperture extending at an angle to a longitudinal extend of said gate and a gap issuing laterally into the elongate aperture to realize said spar.

* * * * *